United States Patent [19]

Traut et al.

[11] Patent Number: 5,071,472

[45] Date of Patent: Dec. 10, 1991

[54] INDUCTION SLAG REDUCTION PROCESS FOR PURIFYING METALS

[75] Inventors: Davis E. Traut, Corvallis; George T. Fischer, II, Albany; Dennis A. Hansen, Corvallis, all of Oreg.

[73] Assignee: The United States of America, as represented by the Secretary of the Interior, Washington, D.C.

[21] Appl. No.: 631,838

[22] Filed: Dec. 21, 1990

Related U.S. Application Data

[63] Continuation-in-part of Ser. No. 907,341, Sep. 15, 1986, Pat. No. 4,985,069.

[51] Int. Cl.[5] ..... C22B 34/00

[52] U.S. Cl. ..... 75/10.18; 75/612; 75/613

[58] Field of Search ..... 75/10.18, 612, 613

[56] References Cited

U.S. PATENT DOCUMENTS 3,101,267 8/1963 Dunn ..... 75/10.18

3,472,648 10/1969 Suriani ..... 75/613

3,493,363 2/1970 Ahearn ..... 75/10.18

3,679,394 7/1972 Buehler ..... 75/10.18

*Primary Examiner*—Peter D. Rosenberg

*Attorney, Agent, or Firm*—E. Philip Koltos

[57] ABSTRACT

A continuous method is provided for purifying and recovering transition metals such as neodymium and zirconium that become reactive at temperatures above about 500° C. that comprises the steps of contacting the metal ore with an appropriate fluorinating agent such as an alkaline metal fluosilicate to form a fluometallic compound, and reducing the fluometallic compound with a suitable alkaline earth or alkali metal compound under molten conditions, such as provided in an induction slag metal furance. The method of the invention is advantageous in that it is simpler and less expensive than methods used previously to recover pure metals, and it may be employed with a wide range of transition metals that were reactive with enclosures used in the prior art methods and were hard to obtain in uncontaminated form.

19 Claims, 1 Drawing Sheet

INDUCTION SLAG REDUCTION PROCESS FOR PURIFYING METALS

This application is a continuation-in-part of U.S. patent application Ser. No. 907,341, originally filed on Sept. 15, 1986 now U.S. Pat. No. 4,985,069.

FIELD OF THE INVENTION

The invention relates in general to a method for the purification and recovery of reactive metals, and in particular to a continuous process for recovering metals that are reactive at temperatures above about 500° C. wherein the metal ore is contacted with a fluorinating agent to form a fluometallic compound which is then reduced in the presence of an alkaline earth metal such as calcium or magnesium or an alkali metal such as sodium or potassium under molten conditions so as to form the purified metal which is then recovered.

BACKGROUND OF THE INVENTION

There is currently a rising demand for a variety of valuable metals which are used in a wide range of applications throughout the industrial arts and in scientific research. For example, neodymium, a rare-earth group metal, is finding increasing demand in applications that require permanent magnets. Zirconium, which has excellent corrosion resistance and low neutron absorption, has been employed extensively for structural purposes in the nuclear reactor industry and in chemical processing equipment. Titanium is a lightweight, noncorrosive, high strength metal that has found extensive use in the aircraft industry, the chemical processing industry and other energy-related fields.

At present, however, efforts to obtain large quantities of these valuable metals , particularly those in Groups IIIB and IVB or other metals that become extremely reactive at temperatures above about 500° C., have suffered from various drawbacks. For example, neodymium is currently produced by a calciothermic reaction of neodymium trifluoride in a batch process where the temperature must be carefully controlled in order to reduce tantalum solubility in the neodymium. In this process, however, even with careful control there is generally some tantalum contamination present in the resulting neodymium metal product. Other methods of neodymium production have also failed to produce satisfactory levels of high-purity neodymium metal.

With regard to zirconium and titanium, these metals are currently produced by a magnesiothermic reduction commonly referred to as the Kroll process, such as described in U.S. Pat. No. 2,205,854. The Kroll process involves a batch procedure wherein the metal salt is fed into a reactor in the presence of molten magnesium under an inert atmosphere. This process requires several batch operational steps which are technically and economically disadvantageous to the production of the metal product, and the overall procedure suffers from the fact that it is a non-continuous operation that entails complex processing steps and high energy consumption.

It has been a particular problem with many transition group metals, such as those described above, that they are somewhat reactive at temperatures above about 500° C. and as a result, when molten, have a strong tendency to react with most materials commonly used for their containment. This usually results in impurities that remain in the finished metal product. It is thus preferred that a reactor useful in purifying metals such as zirconium, neodymium and titanium be one wherein the enclosure will be nonreactive with the treated metals in the molten state. It will also be highly preferable that such a reactor provides for a reaction volume with sufficient residence time to complete the reaction, an input of heat sufficient to maintain the metals and other reactants in molten condition, and a system for mixing reactants and products to ensure reactant availability for reaction and product homogeneity, all in a continuous process wherein products and by-products are removed.

One such reactor which will be suitable for the preferred steps described above is disclosed in U.S. Pat. No. 3,775,091, incorporated herein by reference. The apparatus described therein is designed to melt refractory metals such as titanium, zirconium and their alloys in an induction-heated, liquid-cooled, segmented copper crucible. The bottom of the crucible is formed by the cooled melt material, and a continuous metal ingot of the desired material may be produced and withdrawn from the apparatus. The system is designed so that calcium fluoride and the refractory metal are fed into the crucible, and the calcium fluoride forms an insulating layer to protect the cooled copper. Water-cooled copper coils are also provided around the crucible in order to carry the alternating current for the induction heating.

It is thus a highly desirable object to develop a system whereby the apparatus as disclosed in U.S. Pat. No. 3,775,091 can be used to carry out the purification of a wide variety of metals in an efficient and continuous process, and it is also highly desirable to provide a method wherein a variety of metals can be recovered in purified form from a reactor that does not become reactive with the purified metal, that provides sufficient heat input and residence time to complete the reaction, and which ensures efficient reactant availability and product homogeneity.

SUMMARY OF THE INVENTION

These and other objects are achieved in the method of the present invention wherein an induction slag melting furnace as described above is used in the continuous production and recovery of a purified transition group metal, and the formation of that metal into an ingot. The process is particularly suitable for those reactive metals that are prone to react at temperatures above about 500° C., and comprises the steps of contacting an ore of the metal with a fluorinating agent to form a fluometallic compound, reducing the fluometallic compound with an appropriate alkaline earth metal such as calcium or magnesium, and recovering the purified metal. The method of the present invention is particularly suited for recovery of metals such as zirconium, neodymium, titanium and other similarly reactive metals, and is highly advantageous in that greater amounts of valuable metals and their alloys can be produced in purified form in a continuous process that is highly efficient and relatively inexpensive.

Other features and advantages of the invention will be set forth in, or apparent from, the detailed description of preferred embodiments of the invention which follows.

DETAILED DESCRIPTION OF THE PREFERRED EMBODIMENTS

In accordance with the present invention, there is provided a continuous process for purifying and recovering transition metals, particularly those which are reactive at temperatures above about 500° C. and as a result tend to react with most materials commonly used for their containment. The method will be described in particular with regard to the embodiments for producing purified neodymium and zirconium or their alloys, but it is understood that one skilled in the art will be able to apply the present method to a variety of similar metals. Included among the metals which can be recovered using the method of the present invention are scandium, hafnium, niobium and tantalum. The application of the present process with regard to titanium has been described in detail in U.S. patent application Ser. No. 907,341, incorporated herein by reference.

In the preferred method, the reactive metal is prepared for treatment in accordance with the invention by taking the metal ore and contacting it with a suitable fluorinating agent so that a fluometallic compound is formed. By suitable fluorinating agent is meant any of the many known fluorinating agents that will react with the desired metal ore to produce a stable metal fluoride compound which will ultimately produce the purified metal. Examples of suitable fluorinating agents are alkaline earth metal fluorides, alkaline earth metal fluorosilicates and hydrofluoric acid. It will be readily understood by one skilled in the art that particular fluorinating agents will preferably be chosen for use with particular metals. For example, for recovery of titanium from titanium ore, the ore is preferably fluorinated using an alkaline earth fluoride salt such as calcium fluorosilicate or an aqueous hydrofluoric acid solution in order to obtain the fluometallic compound which in this case is calcium fluotitanate. Under certain conditions, the metal can be contacted with suitable alkali metals such as sodium or potassium to obtain the fluometallic compound.

The contacting step can be carried at a temperature suitable for the fluorination reaction to take place, and this is usually dependent upon the fusion temperature of the resulting salt. In the titanium process described above, the ore mixture is leached at about 50° to 95° C. with water or aqueous hydrofluoric acid solution, and the solution is cooled following a solid-liquid separation step in order to precipitate the alkaline earth fluotitanate solid material which is then separated from the mother liquor. It is also generally preferred that the original ore be ground to expose a greater amount of surface area before the ore is contacted with the fluorinating agent.

Figure 1:
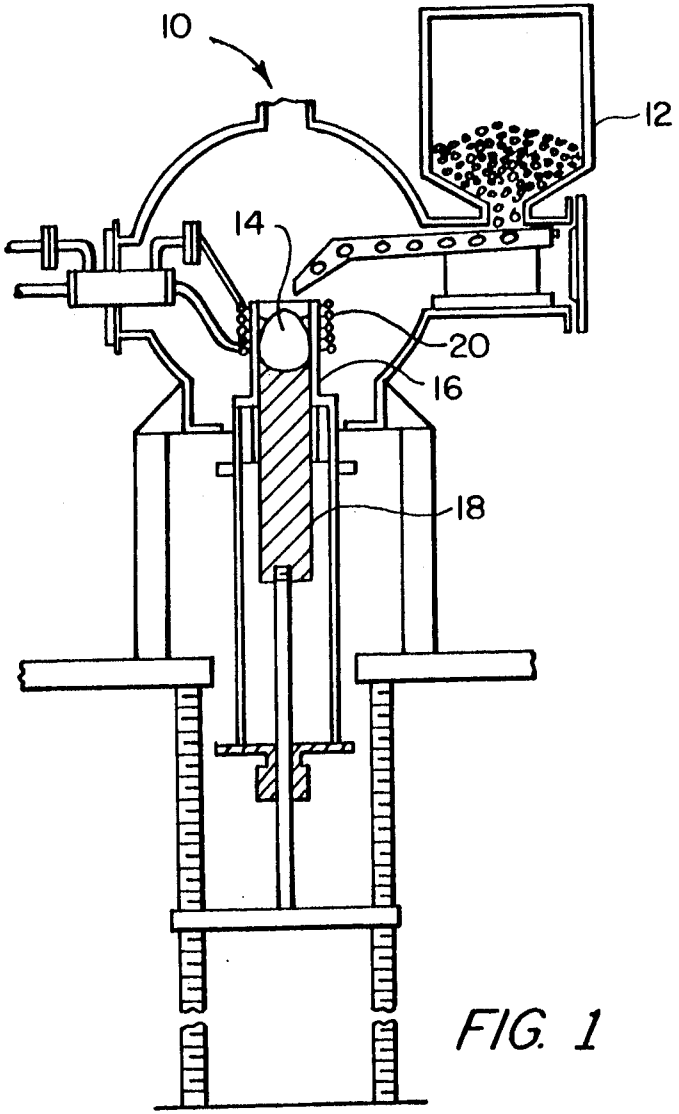
FIG. 1 is a schematic cross-sectional view of an apparatus suitable for use in the method of the present invention.

In the next step of the present method, the fluometallic compound obtained as described above is reduced under molten conditions in the presence of a suitable alkaline earth metal or alkali metal in order to produce the purified form of the desired metal. The reduction steps are preferably carried out in an induction slag metal furnace apparatus such as depicted in FIG. 1, which will be described in greater detail below. In the preferred method, the fluometallic compound is reacted with a suitable alkaline earth reductant, such as calcium or magnesium, or an alkali metal, such as sodium or potassium at temperatures which ensure that the reactive metals will be in molten condition. It is preferred that the fluometallic compound is contacted with the reductant at conditions sufficient to yield on immiscible molten mixture of the reactive metal and the resulting fluoride. Once reduction has taken place, the purified metal can be recovered from the induction furnace as an ingot, and excess alkaline earth or alkali fluoride which forms on the metal can subsequently be removed.

Figure 2:
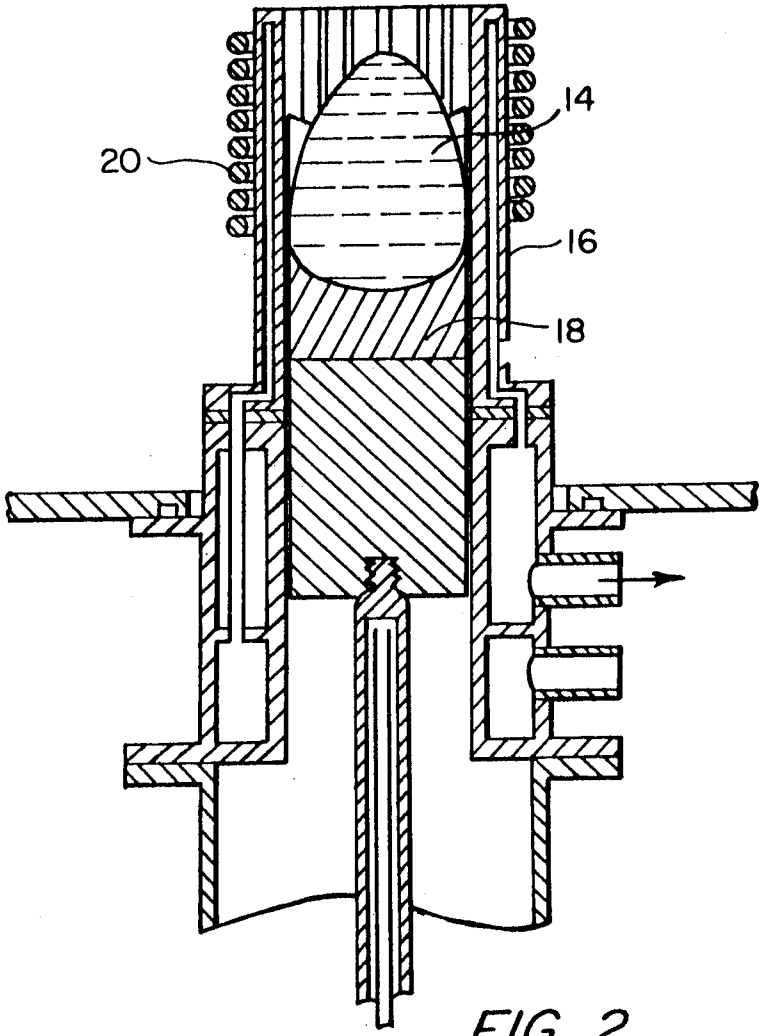
FIG. 2 is an enlarged view of the mixing zone of the apparatus of FIG. 1.

The method of the present invention can be most suitably carried out in an apparatus such as depicted in FIGS. 1 and 2, which shows a reactor of the type disclosed in U.S. Pat. No. 3,775,091. It is preferred that the fluometallic compound obtained as described above is mixed with the reducing agent, preferably either an alkaline earth or alkali reductant, in mixture chamber 12. In this manner, the reactants are mixed and fed to the reactor as a solid flowing mixture into the molten mixing zone 14 of the crucible 16 of the induction slag melting furnace 10. Surrounding crucible 16 is induction coil 20 which is used to heat the reaction mixture. It is also preferred that the introduction of the reactant mixture be carried out in an inert atmosphere such as would be provided by argon gas. Argon gas is preferred since it is cheaper and has a lower heat conductivity than other inert gases such as helium. In the molten mixing zone 14 or furnace crucible 16, the fluometallic compound is reduced to produce the purified metal, or desired alloy upon the addition of the other suitable metal, along with alkaline earth or alkali fluoride as a byproduct. The finished metal product can be removed from the apparatus 10 as an ingot 18 which forms in the crucible and which is coated in a layer of the fluoride byproduct. This byproduct is readily chipped off from the ingot exterior to give the remaining pure metal which is then recovered as desired using conventional means.

In accordance with the teachings of the present invention, it is preferred that the method be carried out so that the metal is continuously fed into the reactor to form a mixture with the reductant, and that the reaction mixture has sufficient residence time in mixing zone 14 to complete the reaction. The heat induced should also be sufficient to maintain the metals and other reactants in the molten condition during the reaction, and the finished reaction products and byproducts are rapidly removed so that a continuous process can be achieved. It is also preferable that the reactants be sufficiently mixed, such as by mixing in mixture chamber 12 and the molten mixing zone 14, so that reactant availability for reactions is maximized, and product homogeneity can be achieved.

In the preferred method, calcium fluoride ($CaF_2$) is the preferred flux material for operation of the induction slag metal furnace. Other alkaline earth halide fluxes can also be used, but these materials would generally have to have boiling points greater than the metal being recovered in order for the furnace to operate at, or less than, the atmospheric pressure of the inert gas. For example, magnesium fluoride ($MgF_2$) is another flux that can be used, but magnesium boils at a lower temperature than calcium, thus making it more difficult to feed into the reaction volume and more likely to be vaporized off before complete reaction.

Unlike previous uses of the induction slag furnace which did not incorporate an integral reduction step, the present method provides that the inductively coupled molten volume of the treated metal serves as a reactor and mixer to reduce the fluometallic compound to the purified form of the metal which is formed into an ingot. Depending on the final desired product, alloys can be readily manufactured in this process by appropriate addition during the reaction step of the desired alloying metals. A number of suitable alloying metals, such as tin, niobium, iron, copper, etc., can be used in the present invention.

It will be clear to one skilled in the art that a suitable fluorinating agent will be chosen to produce the appropriate fluometallic compound that is used in the process of the present invention to obtain the purified reactive metal. For example, if it is desired to obtain purified zirconium metal using the present process, a number of suitable zirconium fluoride compounds could be employed which would be subsequently reduced to give the metal ingot. Preferably, this compound is either calcium hexafluorozirconate ($CaZrF_6$) or potassium hexafluorozirconate ($K_2ZrF_6$). The compound, e.g., $CaZrF_6$, is then fed under inert atmosphere into the molten mixing ball or reaction volume of the induction slag melting furnace along with an alkaline earth reductant such as solid calcium. This reaction takes place as follows:

$$CaZrF_6+2Ca \rightarrow Zr+3CaF_2$$

When the process of the present invention is used to produce neodymium, a fluometallic compound such as neodymium trifluoride ($NdF_3$) is obtained for use in the invention. Suitable fluometallic compounds for other metals to be reduced by means of the present invention will be readily apparent to one skilled in the art.

The present invention thus comprises an advantageous method by which many transition metals, particularly those in Groups IIIB and IVB and those that are reactive at temperatures above about 500° C., can be efficiently purified and recovered in a manner not previously obtainable. The invention provides a simple and relatively inexpensive process for purifying and recovering a great variety of metals that will be extremely valuable in a wide range of industrial and scientific applications. The scope of the invention is as described in the claims appended hereto, and it will be clear that a number of alternate embodiments of the invention not described herein will also be included in its scope.

The following examples are presented only as illustrative of the present invention and are not intended to limit its scope in any way:

EXAMPLE I

In a pioneering experiment, 567 g $K_2ZrF_6$ and 162 g Ca were thoroughly mixed together and placed in induction slag furnace crucible such as the one observed in FIG. 1. The furnace was brought up 45 Kw power at 60 pct power factor, initiating the reduction reaction in about 8 min. The power was shut off and the furnace cooled. The product was removed and was found to contain 70 g Zr, which represents a 31 percent yield. The free energies of formation for $K_2ZrF_6$ and $CaZrF_6$ are similar. Although this pioneering experiment used $K_2ZrF_6$ because of availability, use of $CaZrF_6$ is the preferred embodiment in accordance with the invention. Also preferred would be the use of the same hexafluorozirconate salt cation as the reductant.

EXAMPLE II 292 grams of $CaTiF_6$ were fed with approximately 116 grams of Ca into the apparatus as depicted in FIGS. 1 and 2 having a 4-inch ID 24 segment copper crucible within an external vessel. The induction coil was powered by a 100 kW and 10,000 Hz power source. The mixture of $CaTiF_6$ and Ca was fed from the top side by a vibratory feeder. A 5250 gram titanium stub was used, along with 150 grams CaFz to begin the test and obtain a molten mass prior to feeding the reactants. The external vessel, which contained a vibratory feeder, copper crucible, and an induction coil was evacuated to 25 micrometers of Hg, and then backfilled to 3 psia with argon. The power setting for the induction coil was set starting at 30-kW and slowly increased to 70 kW so as to first coat the crucible with molten calcium fluoride slag, and then bring the molten mass up to temperature. Upon forming the molten reaction mass, the power was adjusted to maintain approximately 70 kW and 25 degrees lead on the power factor. Feeding the $CaTiF_6$ and Ca took approximately 25 minutes, during which, after a charge of reactants had been made, the reaction was allowed to go to completion prior to feeding more reactants. The ingot stub, after removal of the byproduct CaFz, weighed 5283 grams, thus 33 grams of titanium was produced and represented a yield of 48 percent. This preliminary and simple test indicates the utility of the invention.

What is claimed is:

1. A continuous process for the purification and recovery of a metal that is reactive at temperatures above about 500° C. from metal ore containing the metal to be purified and recovered comprising the steps of:

(a) contacting the metal ore with a fluorinating agent to form a fluometallic compound;

(b) reducing the fluometallic compound with an alkaline earth metal or alkali metal under molten conditions, to produce the purified metal; and (c) recovering the purified metal.

2. A process according to claim 1 wherein said alkaline earth metal is selected from the group consisting of calcium and magnesium and wherein said alkali metal is selected from the group consisting of sodium and potassium.

3. A process according to claim 1 wherein said fluorinating agent comprises a compound selected from the group consisting of alkaline earth metal fluorides, alkaline earth metal fluosilicates, and hydrofluoric acid.

4. A process according to claim 1 wherein said reduction of the fluometallic compound with the reducing agent is under molten conditions.

5. A process according to claim 1 wherein the reducing step is conducted in an inductively heated reaction volume.

6. A process according to claim 1 wherein said fluometallic compound is reduced by contacting the compound with an alkaline earth metal or alkali metal at conditions sufficient to yield an immiscible molten mixture of the reactive metal and an alkaline earth metal or alkali metal fluoride.

7. A process according to claim 6 wherein said alkaline earth metal fluoride comprises calcium fluoride.

8. A process according to claim 1 wherein a metallic alloy material is produced by the addition of alloy elements to the fluometallic compound reduced by the alkaline earth metal or alkali metal.

9. A process according to claim 8 wherein the reducing step is conducted in an inductively heated reaction volume, and wherein the alloy elements are added to the inductively heated reaction volume.

10. A process according to claim 1 wherein the reactive metal comprises neodymium.

11. A process according to claim 9 wherein the fluometallic compound formed in the contacting step comprises neodymium trifluoride.

12. A process according to claim 1 wherein the reactive metal comprises zirconium.

13. A process according to claim 12 wherein the fluometallic compound is selected from the group consisting of calcium hexafluorozirconate and potassium hexafluorozirconate.

14. A process according to claim 12 wherein the fluometallic compound comprises calcium hexafluorozirconate.

15. A process according to claim 1 wherein the reactive metal is selected from the group consisting of scandium, hafnium, niobium and tantalum.

16. A process according to claim 1 wherein the reactive metal comprises titanium.

17. A process according to claim 16 wherein the fluometallic compound comprises calcium fluotitanate.

18. A process according to claim 1 wherein the reduction step is carried out under an inert gas atmosphere.

19. A continuous process for purifying and recovering a metal that is reactive at temperatures above about 500° C. comprising the steps of:

(a) continuously feeding the metal in the form of a fluometallic metal compound and an alkaline earth metal or alkali metal reductant into a reactor in order to form a mixture;

(b) heating the mixture at a temperature sufficient to melt the contents of the mixture so as to allow the reduction of the fluometallic compound by the reductant and the production of the purified metal; and (c) recovering the purified metal.

* * * * *